US005435007A

United States Patent [19]

Kalvestran et al.

[11] Patent Number: 5,435,007

[45] Date of Patent: Jul. 25, 1995

[54] WRIST GUARD

[75] Inventors: Jamie L. Kalvestran, Anoka; William S. Portzline, Minneapolis, both of Minn.; Bryce G. Rutter, University City; John H. Loudenslager, Kirkwood, both of Mo.

[73] Assignee: Rollerblade, Inc., Minneapolis, Minn.

[21] Appl. No.: 85,202

[22] Filed: Jun. 30, 1993

[51] Int. Cl.[6] ..... A41D 13/08; A41D 19/00

[52] U.S. Cl. ..... 2/16; 2/161.1; 2/162

[58] Field of Search ..... 2/16, 20, 159, 160, 2/161.1, 161.2, 161.6, 162, 170; 602/21, 64; 273/59, 61, 62

[56] References Cited

U.S. PATENT DOCUMENTS

| | | | |
|---|---|---|---|
| Re. 32,287 | 11/1986 | Willis . | |
| D. 239,220 | 3/1976 | Norman . | |
| D. 279,140 | 6/1985 | Paulson | D2/361 |
| D. 294,983 | 3/1988 | Purin et al. | D29/20 |
| D. 335,368 | 5/1993 | Houston | D29/20 |
| 2,702,906 | 3/1955 | Causse . | |
| 2,794,638 | 6/1957 | Risher et al. . | |
| 3,123,832 | 3/1964 | Kubik | 2/161 |
| 3,228,035 | 1/1966 | Davis | 2/161.2 |
| 3,255,462 | 6/1966 | Antonious . | |
| 3,262,126 | 7/1966 | Price | 2/159 |
| 3,333,850 | 8/1967 | Miller . | |
| 3,595,575 | 7/1971 | Gooch . | |
| 3,598,408 | 8/1971 | Klose | 2/20 |
| 3,606,614 | 9/1971 | Dimitroff | 2/159 |
| 3,882,548 | 5/1975 | Shinagawa et al. | 2/161.1 |
| 3,911,497 | 10/1975 | Lewis, Jr. et al. . | |
| 4,011,596 | 3/1977 | Chang . | |
| 4,067,063 | 1/1978 | Ettinger . | |
| 4,071,913 | 2/1978 | Rector | 2/20 |
| 4,183,098 | 1/1980 | Knowles, Jr. | 2/162 |
| 4,183,100 | 1/1980 | De Marco . | |
| 4,193,135 | 3/1980 | Rhee . | |
| 4,400,829 | 8/1983 | Willis . | |
| 4,416,026 | 11/1983 | Smith . | |
| 4,438,532 | 3/1984 | Campanella et al. . | |
| 4,497,073 | 2/1985 | Deutsch . | |
| 4,519,097 | 5/1985 | Chappell, Jr. et al. . | |
| 4,570,269 | 2/1986 | Berlese | 2/161.1 |
| 4,589,146 | 5/1986 | Taylor . | |
| 4,748,690 | 6/1988 | Webster | 2/20 |
| 4,768,234 | 9/1988 | Yamamoto | 2/161 A |
| 4,810,559 | 3/1989 | Fortier et al. . | |
| 4,843,651 | 7/1989 | Gramza et al. | 2/161 A |
| 4,877,242 | 10/1989 | James . | |
| 4,905,321 | 3/1990 | Walunga | 2/161 A |
| 5,065,457 | 11/1991 | Henson . | |
| 5,163,678 | 11/1992 | Rogers | 2/16 |
| 5,295,269 | 3/1994 | Ballard | 2/18 |

FOREIGN PATENT DOCUMENTS

| | | |
|---|---|---|
| 333943 | 12/1903 | France . |
| 2622466 | 12/1977 | Germany . |
| 19967 | of 1899 | United Kingdom . |

*Primary Examiner*—Clifford D. Crowder
*Assistant Examiner*—Michael A. Neas
*Attorney, Agent, or Firm*—Merchant, Gould, Smith, Edell, Welter & Schmidt

[57] ABSTRACT

A wrist guard for protecting a wearer's wrist includes a first rigid plate member and a second rigid plate member. The plate members are connected by a hinge such that the first and second plate members pivot relative to each other about an axis generally parallel to a bending axis of the wrist. The hinge accommodates substantially unrestricted downward pivotal movement and a substantially restricted upward pivotal movement.

7 Claims, 7 Drawing Sheets

WRIST GUARD

I. BACKGROUND OF THE INVENTION

1. Field of the Invention

This invention pertains to protective wear. More particularly, this invention pertains to a wrist guard to prevent injury to a wearer's arm, wrist and hand.

2. Description of the Prior Art

A wide variety of protective gear is known for protecting sports enthusiasts from injury. Included within the wide variety is protective gear to protect the wrist and arm of a user. Examples of such are shown in U.S. Pat. Nos. 4,400,829, 4,497,073 and 4,011,596.

Recent years have seen a resurgence in the popularity of roller skating. Most notably in-line skating has developed into a popular recreational sport.

During skating, from time to time, a skater may fall. Typically, the skater is skating on relatively hard surfaces such as asphalt, concrete or other pavement material. Naturally, when falling, a skater may extend his arm to break his fall. This can result in abrasion of the hand and arm. Also, when falling, the hand may be pushed backward relatively to the forearm to such an extent that the wrist is hyperextended resulting in strains or possible breakage of bone.

It is an object of the present invention to provide a wrist guard which minimizes hyperextension and which provides protection against abrasion.

II. SUMMARY OF THE INVENTION

According to a preferred embodiment of the present invention, a wrist guard is provided for protecting a wearer's wrist. The wrist guard includes a first rigid plate member and a second rigid plate member. The first rigid plate member is secured to the back of the wearer's hand. The second plate member is secured to the wearer's forearm in close proximity to the wearer's wrist. The first and second rigid plate members are connected by a hinge member which permits the plate members to pivot relative to each other about an axis generally parallel to a bending axis of the wrist. The hinge member accommodates a substantially unrestricted downward pivotal movement while providing a substantially restricted upward pivotal movement. Further aspects of the invention include abrasion-resistant pads secured to the palm side of the bearer's hand.

III. BRIEF DESCRIPTION OF THE DRAWINGS

IV. DESCRIPTION OF THE PREFERRED EMBODIMENT

Figure 1:
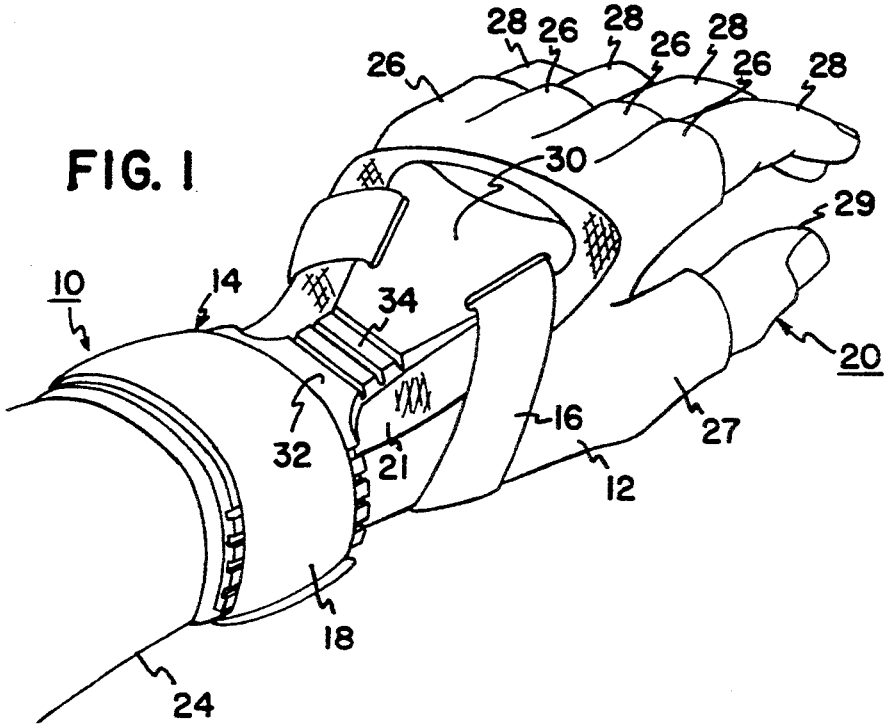
FIG. 1 is a top view of the wrist guard of the present invention worn on a user's hand.

Referring now to the several drawing figures in which identical elements are numbered identically throughout, a description of the preferred embodiment of the present invention will now be provided.

The present invention pertains to a wrist guard 10. The wrist guard 10 includes a glove 12, a spine member 14, a first fastener 16 and a second fastener 18.

The glove 12 is sized to be received upon the hand 20 of the wearer and extend beyond the wrist 22 and at least partially up the forearm 24. As shown, the finger pockets 26 (and thumb pocket 27) of the glove 12 are cut off such that the fingers 28 (and thumb 29) of the wearer are exposed to at least the first and preferably the second knuckle of four fingers and the first knuckle of the thumb. The exposure of the fingers and thumb permits a cooler feel to the glove and also enhances the dexterity of the wearer.

Preferably, the glove 12 is padded. Also, preferably, the glove will be provided with an inner lining (not shown) of a wicking material to draw moisture away from the wearer's hand. The upper surface 21 of the glove is a mesh material for ventilation and coolness. The lower surface 23 and pockets 26,27 of the glove are preferably leather or synthetic leather for abrasion resistance.

Figure 5:
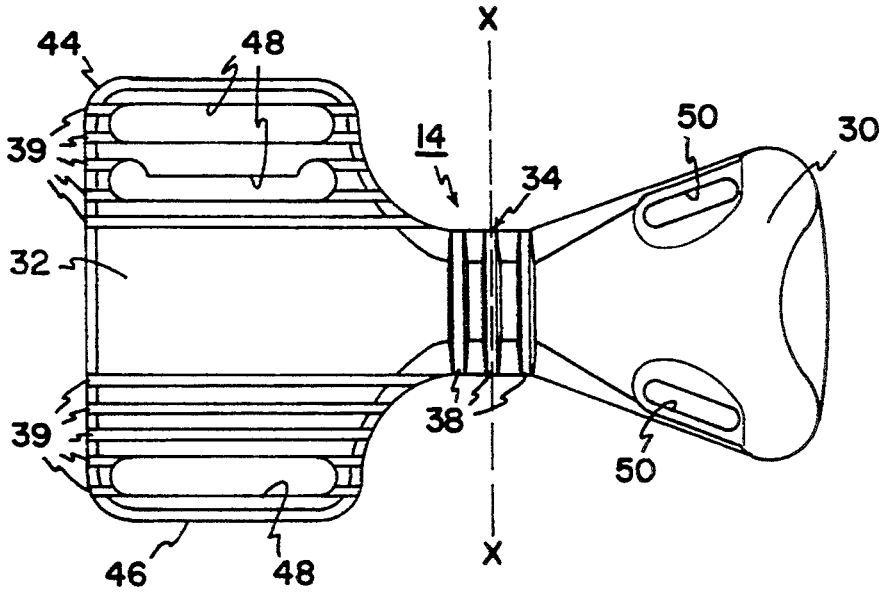
FIG. 5 is a top plan view of a spine member for use with the present invention.
Figure 6:
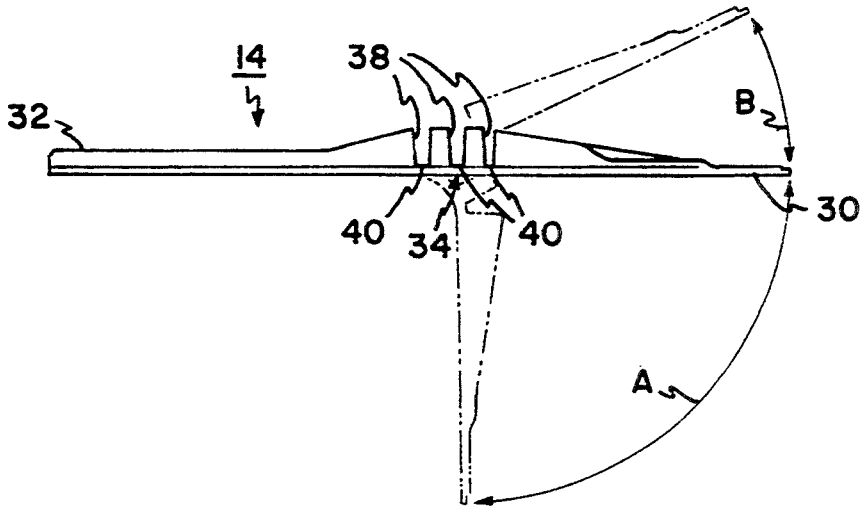
FIG. 6 is a side elevation view of the spine of FIG. 5.
Figure 7:
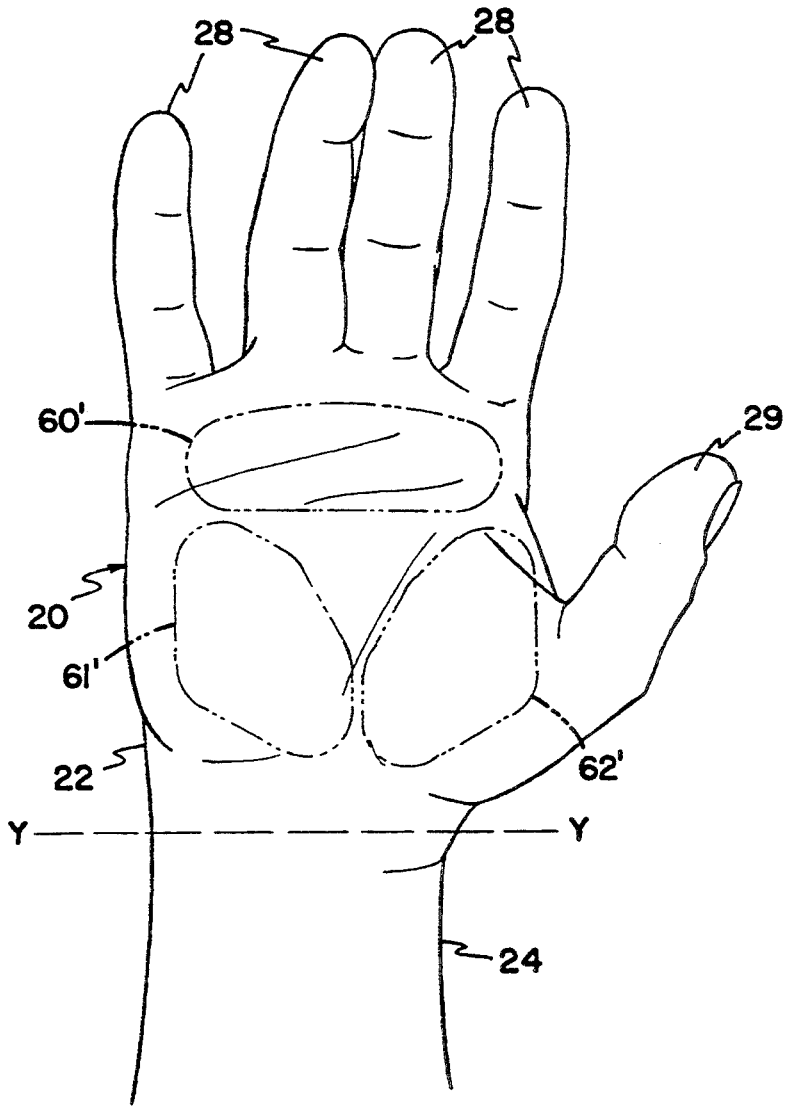
FIG. 7 is an elevation view of a palm side of a hand showing regions protected by the present invention.
Figure 8:
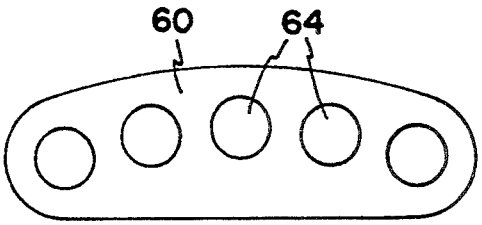
FIG. 8 is a plan view of a first protective pad for use with the present invention.
Figure 9:
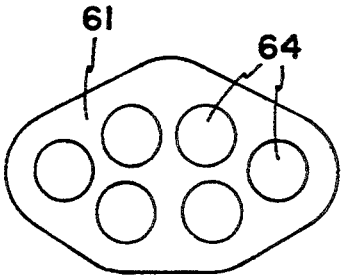
FIG. 9 is a plan view of a second protective pad for use with the present invention.
Figure 10:
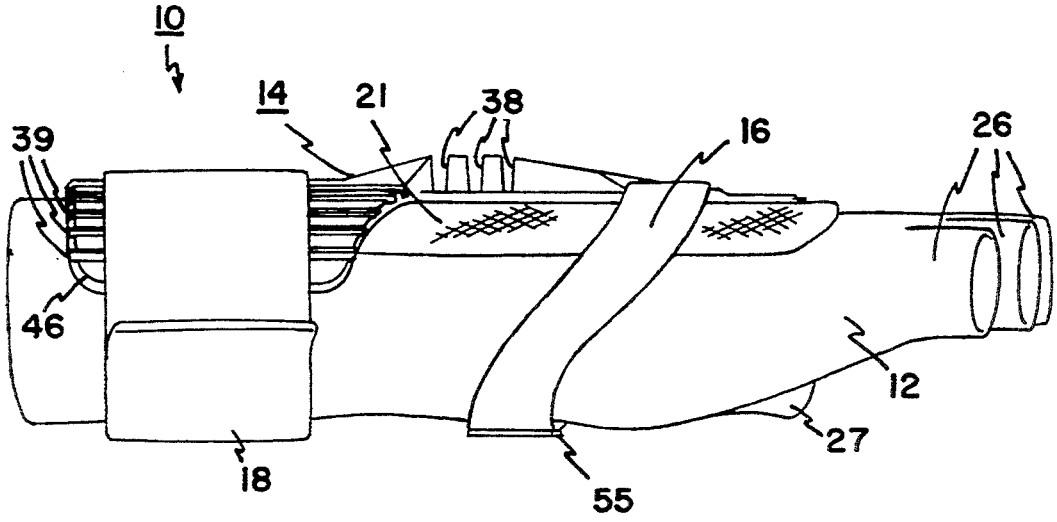
FIG. 10 is a right side elevation view of the wrist guard of FIG. 3.
Figure 11:
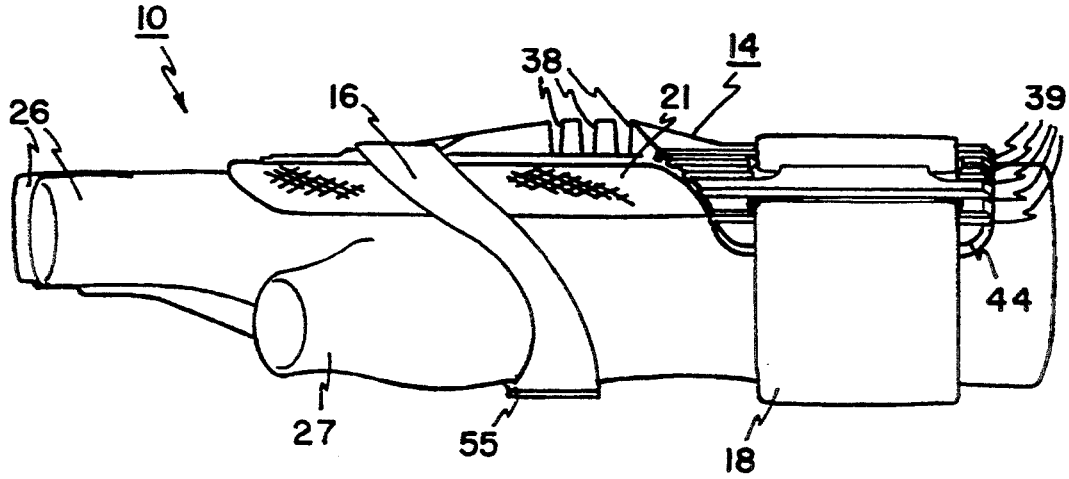
FIG. 11 is a left side elevation view of the wrist guard of FIG. 3.
Figure 12:
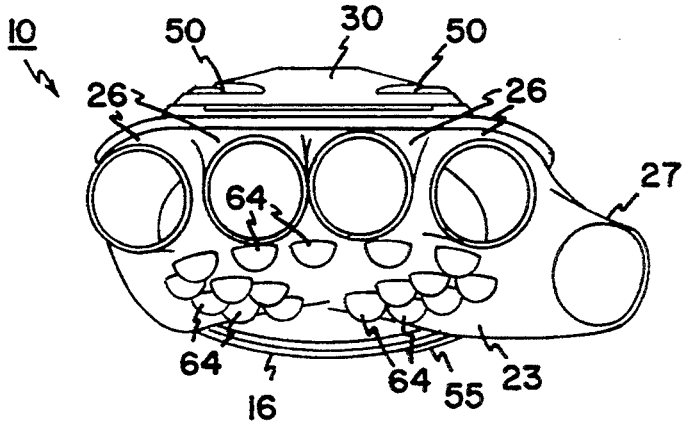
FIG. 12 is a front end view of the wrist guard of FIG. 3.
Figure 13:
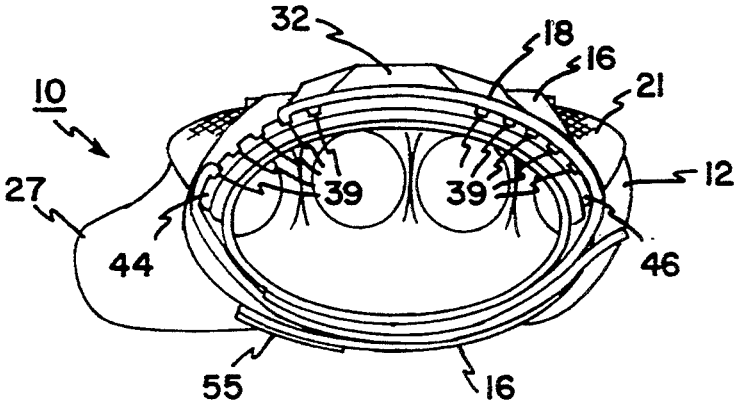
FIG. 13 is a rear end view of the wrist guard of FIG. 3.

With best reference to FIGS. 5 and 6, the spine 14 includes a first rigid plate 30 and a second rigid plate 32 integrally connected by a hinge member 34. As best shown in FIG. 6, the under-surface of the first and second rigid plates 30,32 as well as the hinge member 34 are generally planar when the spine 14 is in the rest position shown in FIG. 6.

The hinge member 34 has a thickness greater than that of the first and second plates 30,32. Formed on the outer surface of the hinge member are a plurality of grooves 38 which run transverse to the longitudinal axis of the spine member 14. The grooves may include various configurations, i.e., inverted V-shape, inverted U-shape, etc. As a result of the grooves 38, the hinge member has a plurality of transverse reduced thickness portions 40. Spine member 14 is preferably formed of a high-impact injection-molded plastic which is flexible about the reduced thickness portions 40. Accordingly, the plates 30,32 pivot about an axis X—X.

The spine member 14 is secured to the glove such that the first rigid plate 30 opposes and covers the back of the hand. Rigid plate 32 opposes the central portion of the back of the forearm adjacent the wrist. The hinge member 34 is positioned above the wrist. The axis X—X is generally parallel to the bending axis Y—Y of the wrist.

Due to the grooves 38, the plates 30,32 may pivot in a substantially unrestricted downward pivotal movement (arrow A in FIG. 6). However, the rigid plates 30,32 are restricted in the upward pivotal movement as shown in FIG. 6 (arrow B). Namely, at preferably about 25° to 30°, the grooves 38 close such that the material of the hinge member 34 is abutting, preventing further upward pivotal movement. Accordingly, during use, the spine 14 prevents the hand from pivoting upward relative to the forearm. Although the spine member 14, is restricted in its pivotal movements to 25°–30°, there may be some tolerances and looseness of fit in the glove such that the hand is limited to pivotal movement of approximately 45°–60° relative to the forearm to prevent hyperextension.

Figure 2:
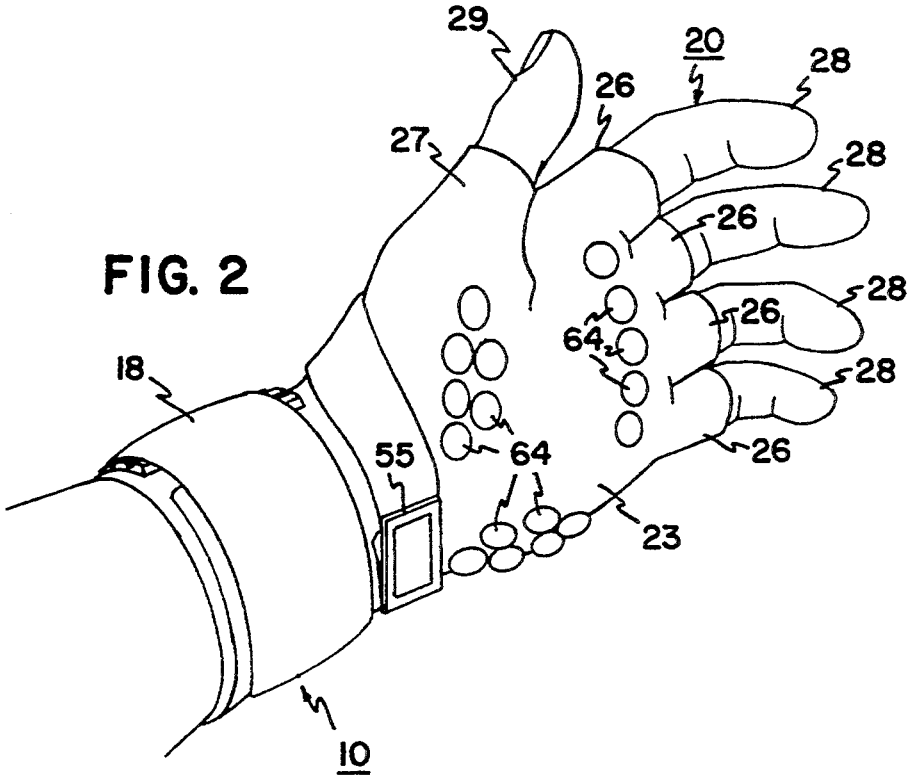
FIG. 2 is a bottom view of the view of FIG. 1.
Figure 4:
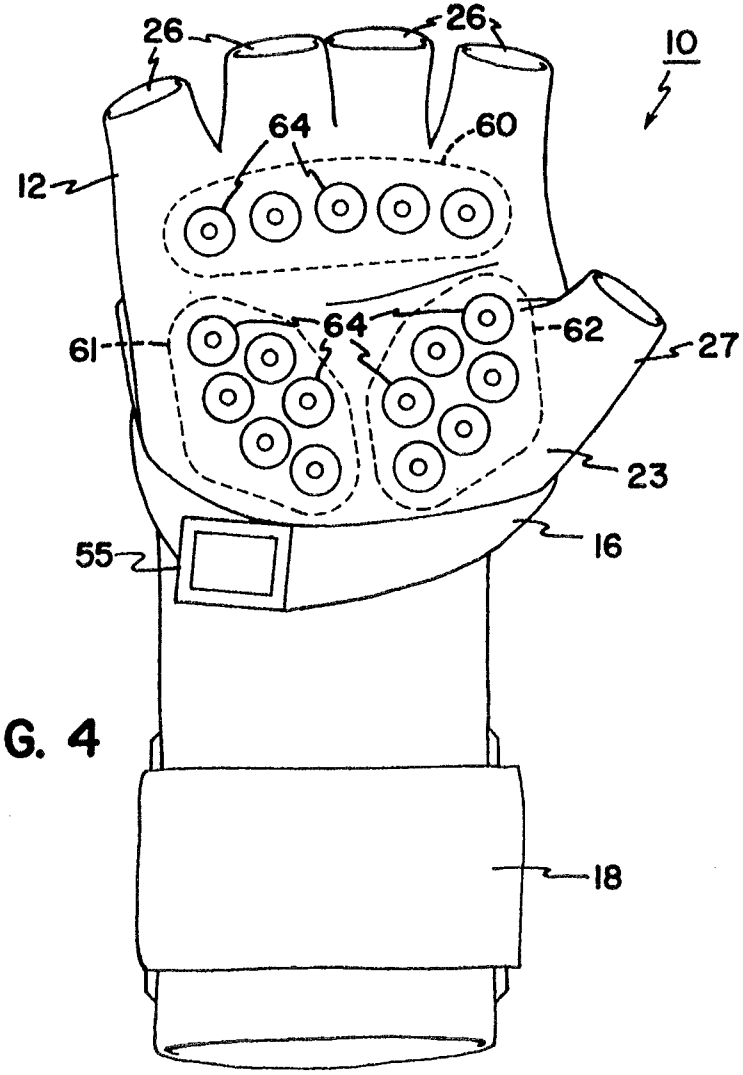
FIG. 4 is a bottom plan view of the wrist guard.
Figure 3:
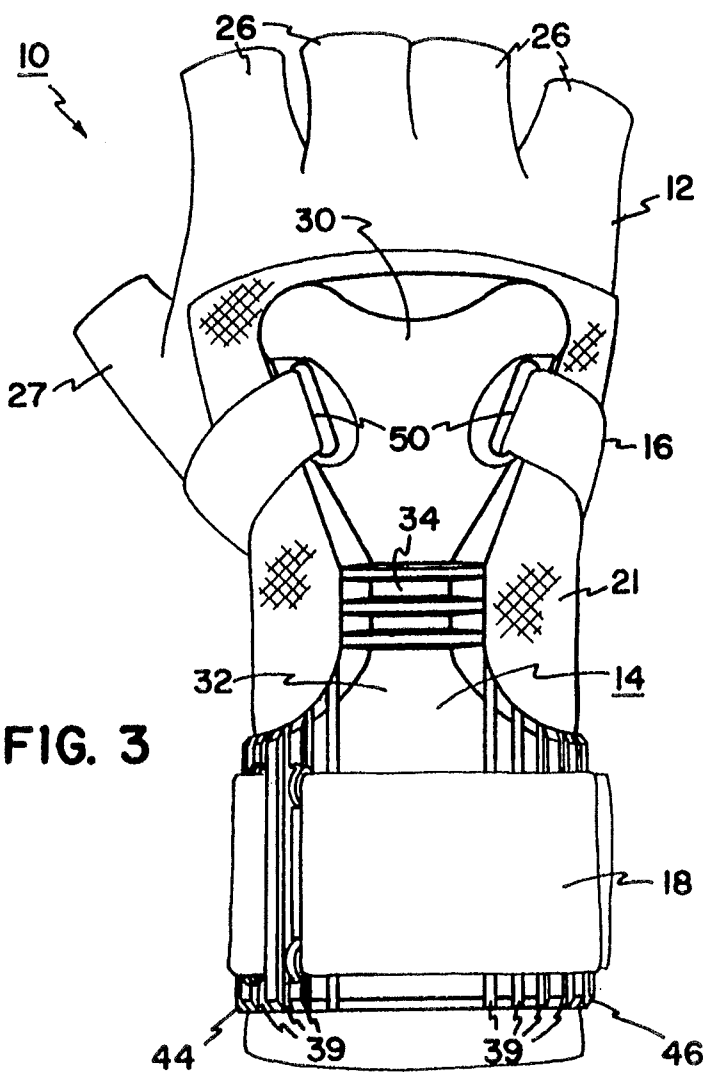
FIG. 3 is a top plan view of the wrist guard of the present invention.

With reference to FIG. 5, the spine member 14 has laterally extending side extensions 44,46 extending from the sides of the second rigid plate 32. Each of the side extensions 44,46 has on its upper surface a plurality of grooves 39 formed therethrough extending in a direction generally parallel to the longitudinal direction of the spine member 14. As a result of the grooves 39, the side extensions 44 are flexible such that they can bend around and conform to the forearm of the wearer (as shown in FIGS. 1 and 2).

A plurality of slots 50 are formed through opposite sides of the first rigid plate 30. Accordingly, a strap fastener 16 can be stitched to the glove 12 and extend through the slots 50. A VELCRO TM fastener 55 carried on the first fastener 16 permits the wearer to tighten the first rigid plate 30 against the back of the hand. Similarly, the side members 44,46 are provided with slots 48 through which the second fastener 18 passes with the second fastener 18 stitched to the glove 12 at one end, permitting tightening of the second rigid plate 32 against the back of the forearm. In this manner, the spine 14 is rigidly secured to the hand and wrist of the wearer.

Stitched into the glove 12 are a plurality of injection-molded abrasion-resistant pads 60, 61, 62 (pads 61 and 62 are identical and a description of one will suffice as a description of the other). The pads 60–62 have hemispherical protrusions 64. The protrusions 64 extend through cutouts in the leather or synthetic leather material of the glove 12. The pads are sized and positioned such that pad 60 opposes the metacarpi region 60' of the hand. Pad 61 covers and opposes the thenar region 61' of the hand and pad 62 opposes and covers the antithenar region 62' of the hand. The pads 60–62 provide impact and abrasion resistance and protection to the glove 12.

From the foregoing detailed description of the present invention, it has been shown how the objects of the invention have been attained in a preferred manner. However, modifications and equivalents of the disclosed concepts, such as those which readily occur to one skilled in the art, are intended to be included within the scope of the claims which are appended hereto.

What is claimed is:

1. A wrist guard for protecting a wearer's wrist, said wrist guard comprising:

a first rigid plate member;

first fastening means for fastening said first plate members to a back of said wearer's hand;

a second rigid plate member;

second fastening means for fastening said second plate member to a back of said wearer's forearm in close proximity to said wearer's wrist;

hinge means for connecting said first plate member and said second plate member to pivot relative to each other about an axis generally parallel to a bending axis of said wrist, said hinge means accommodating substantially unrestricted downward pivotal movement and a substantially restricted upward pivotal movement to a point of maximum upward bending;

said plate members and hinge means integrally formed of impact resistant plastic having a first surface opposing said wrist and second surface opposite said first surface; a plurality of transverse grooves in said second surface to define a plurality of transverse reduced thickness portions with said material bendable at said portions and with said grooves disposed between opposing surfaces of said plastic, said grooves positioned to be disposed against a wearer's wrist when said first and second plate members are secured to said hand and forearm;

said grooves sized for said opposing surface to at least partially abut when said hinge means is at said point of maximum upward bending.

2. A wrist guard according to claim 1 wherein grooves are inverted grooves.

3. A wrist guard according to claim 1 comprising a glove for insertion of wearer's hand and with said glove extending partially up said forearm, said first and second fastener means secured to said glove to tighten said glove.

4. A wrist guard according to claim 3 further comprising a plurality of abrasion resistant pads carried on a palm of said glove.

5. A wrist guard according to claim 4 wherein said plurality of pads includes a first pad positioned opposing the metacarpi of said hand.

6. A wrist guard according to claim 4 wherein said plurality of pads includes a second pad positioned opposing the thenar of said hand.

7. A wrist guard according to claim 4 wherein said plurality of pads includes a third pad opposing antithenar of said hand.

* * * * *